US007828143B2

(12) United States Patent
Tosaka et al.

(10) Patent No.: US 7,828,143 B2
(45) Date of Patent: Nov. 9, 2010

(54) CIGARETTE BOX AND AN OUTER BLANK THEREFOR

(75) Inventors: Masahiko Tosaka, Tokyo (JP); Tetsuya Nakamura, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 171 days.

(21) Appl. No.: 12/073,526

(22) Filed: Mar. 6, 2008

(65) Prior Publication Data

US 2008/0164161 A1 Jul. 10, 2008

Related U.S. Application Data

(63) Continuation of application No. PCT/JP2006/316253, filed on Aug. 18, 2006.

(30) Foreign Application Priority Data

Sep. 8, 2005 (JP) ..... 2005-260661

(51) Int. Cl.
*A24F 15/00* (2006.01)
*B65D 85/10* (2006.01)
*B65D 43/16* (2006.01)

(52) U.S. Cl. ..... 206/268; 229/87.13; 229/160.1

(58) Field of Classification Search ..... 206/264–276; 229/120.18, 146
See application file for complete search history.

(56) References Cited

U.S. PATENT DOCUMENTS

| | | | | |
|---|---|---|---|---|
| 2,071,394 | A | 2/1937 | Douglas | |
| 2,281,058 | A | 4/1942 | Winterbourne | |
| 4,951,862 | A * | 8/1990 | Taddia et al. | 229/160.1 |
| 5,236,084 | A * | 8/1993 | Evers | 206/273 |
| 5,511,722 | A * | 4/1996 | Dixon | 229/225 |
| 5,513,752 | A * | 5/1996 | Gottlieb | 206/387.1 |
| 5,553,773 | A | 9/1996 | Focke et al. | |
| 5,630,544 | A * | 5/1997 | Shane | 229/117.06 |
| 5,715,936 | A * | 2/1998 | Focke et al. | 206/268 |
| 5,738,207 | A * | 4/1998 | Trimani | 206/268 |
| 5,842,631 | A * | 12/1998 | Berger | 229/120.13 |
| 5,918,734 | A | 7/1999 | Devens et al. | |
| 6,112,892 | A * | 9/2000 | Thibaud | 206/242 |
| 6,527,166 | B1 * | 3/2003 | Focke et al. | 229/146 |
| 6,742,652 | B1 * | 6/2004 | Focke et al. | 206/268 |
| 6,923,315 | B2 * | 8/2005 | Lo Duca | 206/232 |
| 7,273,145 | B2 * | 9/2007 | Focke et al. | 206/267 |

FOREIGN PATENT DOCUMENTS

| | | | |
|---|---|---|---|
| CN | 1119167 | A | 3/1996 |
| DE | 80 20 660 | U1 | 11/1980 |
| DE | 198 14 255 | A1 | 10/1999 |
| EP | 1 155 974 | A1 | 11/2001 |
| FR | 011 258 | E | 1/1910 |
| FR | 1 267 865 | A | 7/1961 |

(Continued)

*Primary Examiner*—J. Gregory Pickett
*Assistant Examiner*—Jose S Stephens, III
(74) *Attorney, Agent, or Firm*—Birch Stewart Kolasch & Birch, LLP

(57) ABSTRACT

A cigarette box has a box body, a lid that opens/closes the box body, an outer wall superposed on a rear wall of the box body and forms a pocket (P) in cooperation with the rear wall, and a sheet-like pouch removably contained in the pocket (P), the pouch being used as a portable ash container.

4 Claims, 8 Drawing Sheets

FOREIGN PATENT DOCUMENTS

| | | | |
|---|---|---|---|
| GB | 177 377 | A | 3/1922 |
| JP | 3026114 | U | 7/1996 |
| JP | 8-253279 | A | 10/1996 |
| JP | 3055358 | U | 1/1999 |
| JP | 2001-511368 | A | 8/2001 |
| TW | 192827 | | 10/1992 |
| UA | 85288 | | 7/2005 |
| WO | WO-99/05934 | A1 | 2/1999 |

* cited by examiner

CIGARETTE BOX AND AN OUTER BLANK THEREFOR

This application is a Continuation of copending PCT International Application No. PCT/JP2006/316253 filed on Aug. 18, 2006, which designated the United States, and on which priority is claimed under 35 U.S.C. §120. This application also claims priority under 35 U.S.C. §119(a) on Patent Application No(s). 2005-260661 filed in Japan on Sep. 8, 2005. The entire contents of each of the above documents is hereby incorporated by reference.

TECHNICAL FIELD

The present invention relates to a cigarette box and an outer blank for fabricating the cigarette box, and more specifically, to a cigarette box capable of containing at least one sheet-like article and an outer blank therefor.

BACKGROUND ART

As cigarette boxes of this type, hinged-lid cigarette boxes have widely been used. Such cigarette boxes each contain an inner pack. The inner pack includes a cigarette bundle and a wrapping material that wraps the bundle.

Well known among the above-mentioned cigarette boxes are those that each contain a sheet-like article, or a coupon, together with the inner pack. A cigarette box of this type is disclosed, for example, in Unexamined Japanese Patent Publication No. 8-253279. When the cigarette box disclosed in this publication is opened, a coupon protrudes from the cigarette box.

There is a tendency in recent years that many of public spaces are designated as non-smoking areas. Accordingly, smoking areas in which ashtrays are set up are drastically reduced both inside and outside of buildings. Because of such a smoking environment, smokers have to take along their own ash containers.

However, it is too much bother for a smoker to take along the portable ash container, albeit a small one, in addition to the cigarette box. It is then possible to keep the portable ash container within the cigarette box, instead of inserting the coupon disclosed in the above-mentioned publication.

In this case, the ash container requires a cigarette box of a larger size. On top of that, a used portable ash container gives off an offensive smell, so that it is unfavorable to put the used container back into the cigarette box.

It is an object of the invention to provide a cigarette box that makes it possible to easily carry a sheet-like article, such as a coupon and a portable ash container, along with the cigarette box without the need for enlarging the cigarette box, and an outer blank therefor. More specifically, when the sheet-like article is a portable ash container, an object of the invention is to provide a cigarette box that does not cause a trouble even if the used portable ash container is carried with the cigarette box, and an outer blank therefor.

DISCLOSURE OF THE INVENTION

In order to accomplish the above object, a cigarette box of the invention comprises a box body including an open upper end, a rear wall, and a bottom; a lid connected to the back wall of the box body across a hinge, for opening/closing the upper end of the box body; an inner pack contained in the box body, the inner pack having a cigarette bundle and a wrapping material that wraps the bundle; a pocket provided to a rear face of the box body; and a sheet-like article removably inserted in the pocket.

The sheet-like article is removed from the pocket of the cigarette box as needed. The sheet-like article increases the box body in thickness only slightly. Therefore, the cigarette box of the invention can be sold through a vending machine as with conventional cigarette boxes.

To be specific, the pocket includes an annex wall superposed upon the rear wall of the box body, for allowing a pocket space to be produced between the rear wall and the annex wall. The pocket has a mouth formed between a lid-side edge of the annex wall and the rear wall.

Preferably, the rear wall of the box body has a concave that enlarges the pocket space. This concave reduces an outward bulge of the annex wall when the sheet-like article is contained in the pocket. The cigarette box then has the rear face that is virtually flat, so that the cigarette box does not get stuck in a vending machine when dispensed from the machine. Consequently, the cigarette box is stably dispensed from the vending machine.

When the cigarette box is a hinged-lid package, the concave may extend from the pocket space over a rear face of the lid. In this case, it is desirable that depth of the concave in the pocket space be greater than in the rear face of the lid.

More preferably, the mouth of the pocket is positioned on the hinge of the lid or off the hinge toward the bottom of the box body. In this case, the mouth of the pocket never hampers the opening/closing of the lid.

Preferably, the mouth of the pocket has a shape of a cove that is dented concave toward the bottom of the box body. Such a pocket mouth allows an access to the sheet-like article contained in the pocket and facilitates a removal of the article from the pocket.

More specifically, the sheet-like article is preferably a pouch that is usable as an ash container. The pouch is removed from the pocket prior to smoking and is used as an ash container. After smoking, ashes and butts in the pouch are eliminated. The pouch is then put back into the pocket of the cigarette box and is carried with the cigarette box by the smoker.

Since the pocket is outside the cigarette box, even if the used pouch emits an offensive smell, the smell does not affect the flavor and taste of cigarettes contained in the cigarette box as long as the lid of the cigarette box is closed.

The invention also provides an outer blank and an annex blank for fabricating the cigarette box and the pocket.

BEST MODE OF CARRYING OUT THE INVENTION

Figure 1:
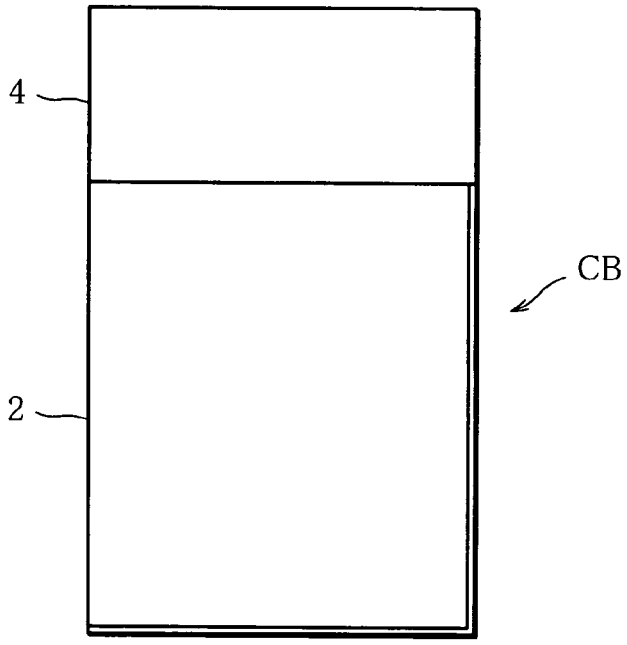
FIG. 1 is a front view of a cigarette box according to a first embodiment of the invention.

Referring to FIG. 1, a cigarette box CB of a first embodiment is called a hinged-lid package and is a rectangular parallelepiped with a longitudinal axis. The cigarette box CB contains an inner pack, not shown. The inner pack includes a bundle of filter cigarettes or cigarettes and a wrapping material that wraps the bundle.

The cigarette box CB is wrapped in a transparent film, not shown, which has a tear tape.

The cigarette box CB includes a box body 2 having an open upper end and a box-shaped lid 4 that opens/closes the upper end of the box body 2. The lid 4 is connected to a back face of the box body 2 across a hinge, or a self hinge. The lid 4 rotates around the self hinge to open/close the upper end, namely the opening, of the box body 2.

Figure 2:
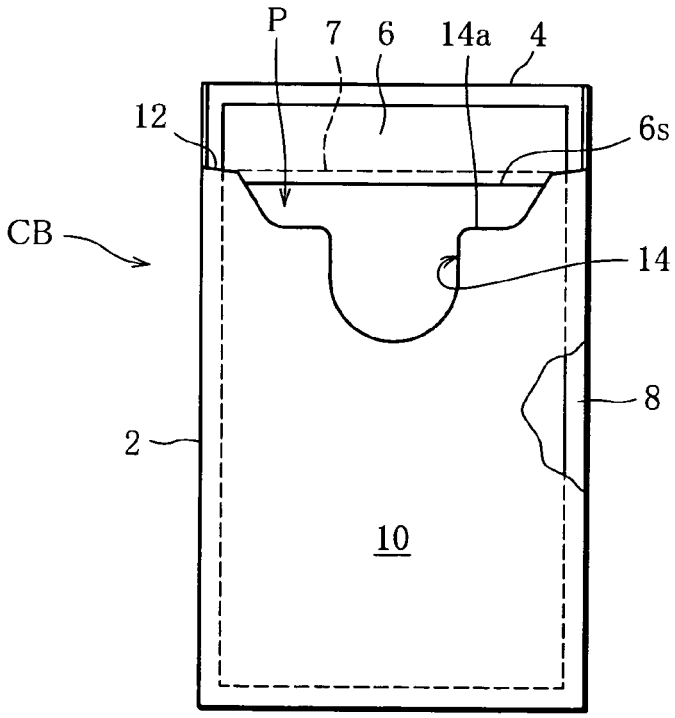
FIG. 2 is a rear view of the cigarette box shown in FIG. 1.
Figure 3:
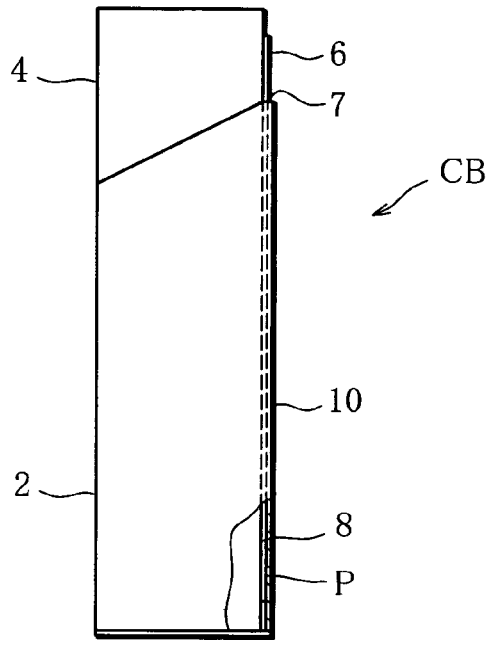
FIG. 3 is a side view of the cigarette box shown in FIG. 1.

As illustrated in FIGS. 2 and 3, the box body 2 holds at least one sheet-like article, for example, a rectangular sheet-like pouch 6 serving as an ash container. The pouch 6 has flexibility and is situated on the back face of the box body 2.

More specifically, the box body 2 includes a double-structure rear wall. The rear wall has an inner wall 8 connected to a rear wall of the lid 4 across the self hinge 7, and an outer wall 10 covering the inner wall 8. The inner wall 8 and the outer wall 10 form a pocket P in cooperation with each other. The pocket P has an opening that opens upwards (toward the lid 4). In other words, an upper edge 12 of the outer wall 10 forms an open edge of the pocket P.

The sheet-like pouch 6 is removably inserted into the pocket P from the opening of the pocket P, and has an upper portion protruding from the opening of the pocket P. The upper portion of the pouch 6 is superposed upon the rear wall of the lid 4.

As is apparent from FIGS. 2 and 3, the upper edge 12 of the outer wall 10 is positioned on or below the self hinge 7 (on the side toward the bottom of the box body 2). This prevents the outer wall 10 from hampering the rotation of the lid 4 around the self hinge 7, that is, the opening/closing of the lid 4.

Because of the flexibility of the sheet-like pouch 6, even if the lid 4 is opened or closed while the upper portion of the pouch 6 is superposed on the rear wall of the lid 4, the pouch 6 does not greatly discourage the opening/closing of the lid 4. However, if smooth opening/closing of the lid 4 is desired, the pouch 6 should be of a size that can be thoroughly accommodated in the pocket P.

As is clear from FIG. 2, an access cove 14 is formed in the upper edge 12 of the outer wall 10. This access cove 14, leaving both end portions of the upper edge 12, has a shallow indentation 14*a* tapered toward the bottom of the box body 2 and a deep indentation 14*b* continuing from a central portion of the indentation 14*a* to further extend toward the bottom of the box body 2. The access cove 14 increases area of the pouch 6, which is exposed from the pocket P, and facilitates a removal of the pouch 6 from the pocket P.

The entire inner surface of the sheet-like pouch 6 is covered with a heat-proof layer, not shown. The pouch 6 has a slit 6*s* (see FIG. 2) only in one side thereof. The slit 6*s* is positioned in the upper portion of the pouch 6 and extends in a width direction of the pouch 6. When opened wide, the slit 6*s* forms an opening of the pouch 6. While smoking a filter cigarette or a cigarette, a smoker can drop ashes and a butt into the pouch 6 through the opening of the pouch 6.

Figure 4:
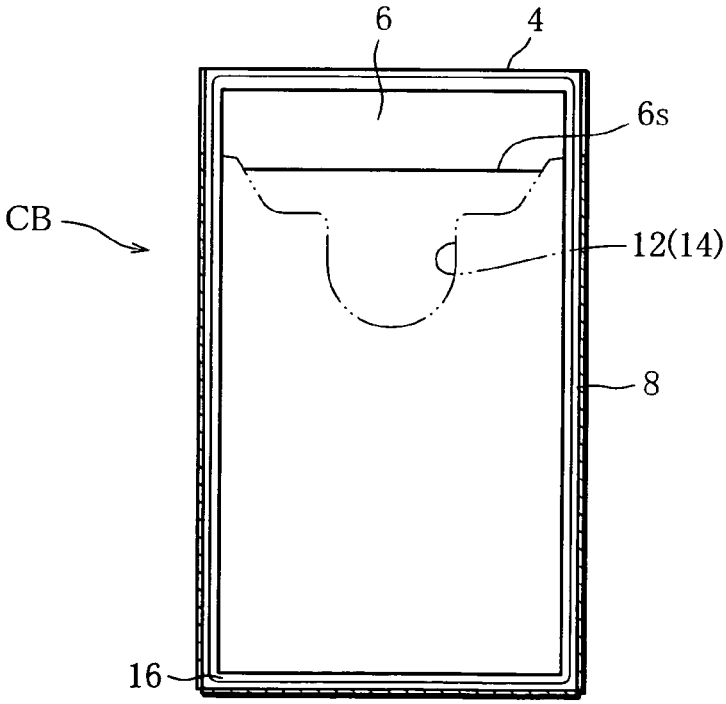
FIG. 4 is a rear view of the cigarette box shown in FIG. 2 without an outer wall of the box.

FIG. 4 shows the box body 2 without the outer wall 10. As illustrated in FIG. 4, there is formed a shallow rectangular concave 16 in the inner wall 8 of the box body 2. The concave 16 extends over the rear wall of the lid 4. The concave 16 is of a size capable of receiving the sheet-like pouch 6. In respect of depth of the concave 16, the depth of the concave 16 in the inner wall 8 is greater than in the rear wall of the lid 4. The concave 16 has a stepped bottom. The concave 16 may be formed only in the inner wall 8.

According to the cigarette box CB, the pouch 6 is pulled out of the cigarette box CB prior to smoking, and the pouch 6 is used as an ash container during smoking. Consequently, the smoker needs to take along no other ash container than the pouch 6 in addition to the cigarette box.

Since the pouch 6 is thin, the cigarette box CB has substantially the same size as conventional cigarette boxes. On this account, when the cigarette box CB is sold through a vending machine, there is no trouble in sales through vending machines. More specifically, the concave 16 formed in the inner wall 8 of the cigarette box CB prevents the outer wall 10 of the cigarette box CB from prominently bulging and protruding from the inner wall 8 when the pouch 6 is accommodated in the pocket P. As a result, the vending machine reliably and stably dispenses the cigarette box CB as well as the conventional cigarette boxes.

After smoking, ashes and butts in the used pouch 6 are eliminated from the pouch 6. The used pouch 6 is then put back into the pocket P of the cigarette box CB. Even after the used pouch 6 is set back into the cigarette box CB, as long as the lid 4 of the cigarette box CB is closed, the offensive smell issuing from the used pouch 6 is unlikely to enter the cigarette box CB. Therefore, the offensive smell from the pouch 6 does not affect the flavor and taste of the filter cigarettes or cigarettes contained in the inner pack.

The pocket P of the cigarette box CB may have capacity capable of containing a plurality of pouches 6. In this case, each of the pouches 6 is disposable.

Figure 5:
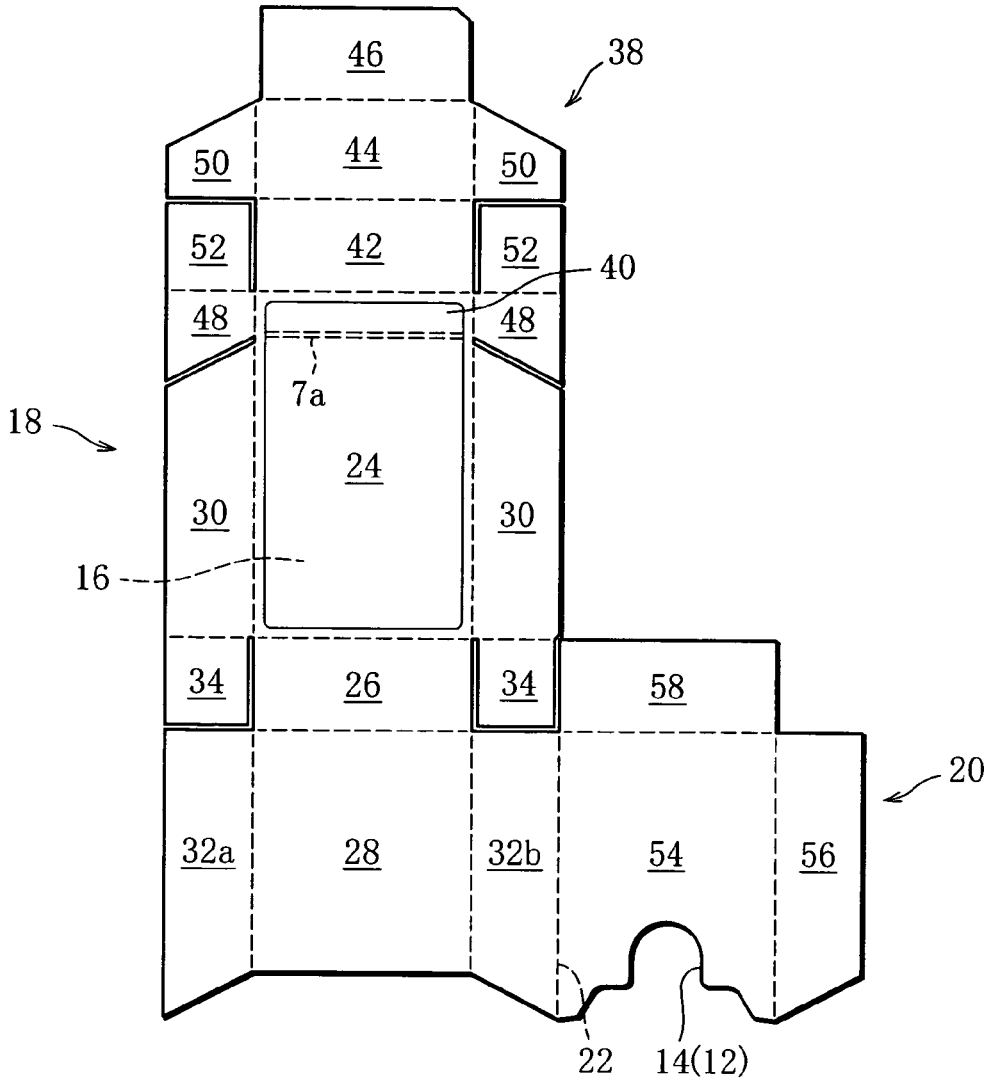
FIG. 5 is a view showing an outer blank for the cigarette box shown in FIG. 1.

FIG. 5 shows an outer blank for fabricating the box body 2 and the lid 4 as viewed from the back side of the blank.

The outer blank includes a main section 18 and a subsection 20. The sections 18 and 20 are connected to each other across a fold line 22 shown by a broken line.

The main section 18 has elements similar to those as panels and flaps included in an outer blank for a conventional hinged-lid package. The adjacent elements are joined to each other across fold lines shown by broken lines.

Concretely, the main section 18 has a rectangular shape extending in a vertical direction as viewed in FIG. 5, and includes a rear panel 24 in the center thereof. An inner bottom panel 26 and a front panel 28 are connected to a lower side of the rear panel 24 in the order named. The panels 24, 26 and 28 are parts for forming the inner wall 8, an inner bottom wall, and a front wall, respectively, of the box body 2.

Connected to both sides of the rear panel 24 are inner side flaps 30. A middle side flap 32*a* and an outer side flap 32*b* are connected to both sides of the front panel 28. Inner bottom flaps 34 are connected to lower edges of the respective inner side flaps 30. The inner bottom flaps 34 are located to both sides of the inner bottom panel 26. The side flaps 30, 32*a*, and 32*b* are parts for forming inner side walls, a middle side wall, and an outer side wall, respectively, of the box body 2. The inner bottom flaps 34 are parts for forming reinforcing members of the inner bottom wall.

Referring to FIG. 5, the main section 18 includes a lid part 38 above the rear panel 24. The lid part 38 is connected to an upper edge of the lid panel 24 across a hinge line 7*a* for forming the self hinge 7. The lid part 38 includes a rear panel 40, a top panel 42, a front panel 44, and a front inner flap 46. The panels 40, 42, and 44 are parts that are arranged in order from the rear panel 24 side and form a rear wall, a top wall, and a front wall, respectively, of the lid 4. The front inner flap 46 is a reinforcing member for the front wall of the lid 4.

Inner side flaps 48 and outer side flaps 50 are connected to both sides of the rear panel 40 and of the front panel 44, respectively. Inner top flaps 52 are connected to the respective inner side flaps 48. The inner top flaps 52 are located on both sides of the top panel 42.

The inner and outer side flaps 48 and 50 are parts for forming the inner side walls and the outer side walls, respectively, of the lid 4. The inner top flaps 52 are reinforcing members of the top wall of the lid 4.

As is obvious from FIG. 5, the subsection 20 includes an outer rear panel 54. The outer rear panel 54 is connected to the outer side flap 32*b* of the main section 18 across the fold line 22. In FIG. 5, the outer rear panel 54 has the access cove 14 in a lower edge thereof. The outer rear panel 54 is a part for forming the outer wall 10 of the box body 2.

An outer side panel 56 and an outer bottom panel 58 are connected to an outer side edge and an upper edge, respectively, of the outer rear panel 54. The panels 56 and 58 are parts for forming an outer side wall and an outer bottom wall, respectively, of the box body 2.

Figure 6:
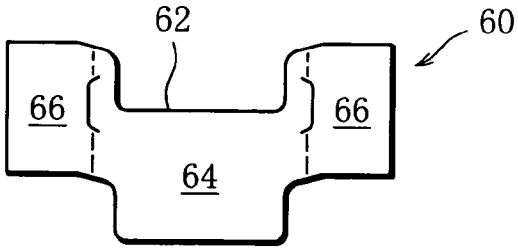
FIG. 6 is a view showing an inner blank for fabricating an inner frame.

FIG. 6 shows an inner blank 60 for the box body 2. The inner blank 60 includes a center panel 64 and side flaps 66 connected to both sides of the center panel 64 across fold lines. In FIG. 6, the center panel 64 has an access cove 62 in an upper edge thereof. The access cove 62 has a substantially U-like shape. The inner blank 60 is used for forming an inner frame of the box body 2.

With reference to FIGS. 7 to 11, a process of folding the outer blank, that is, a method of fabricating the cigarette box CB will be described below.

Figure 7:
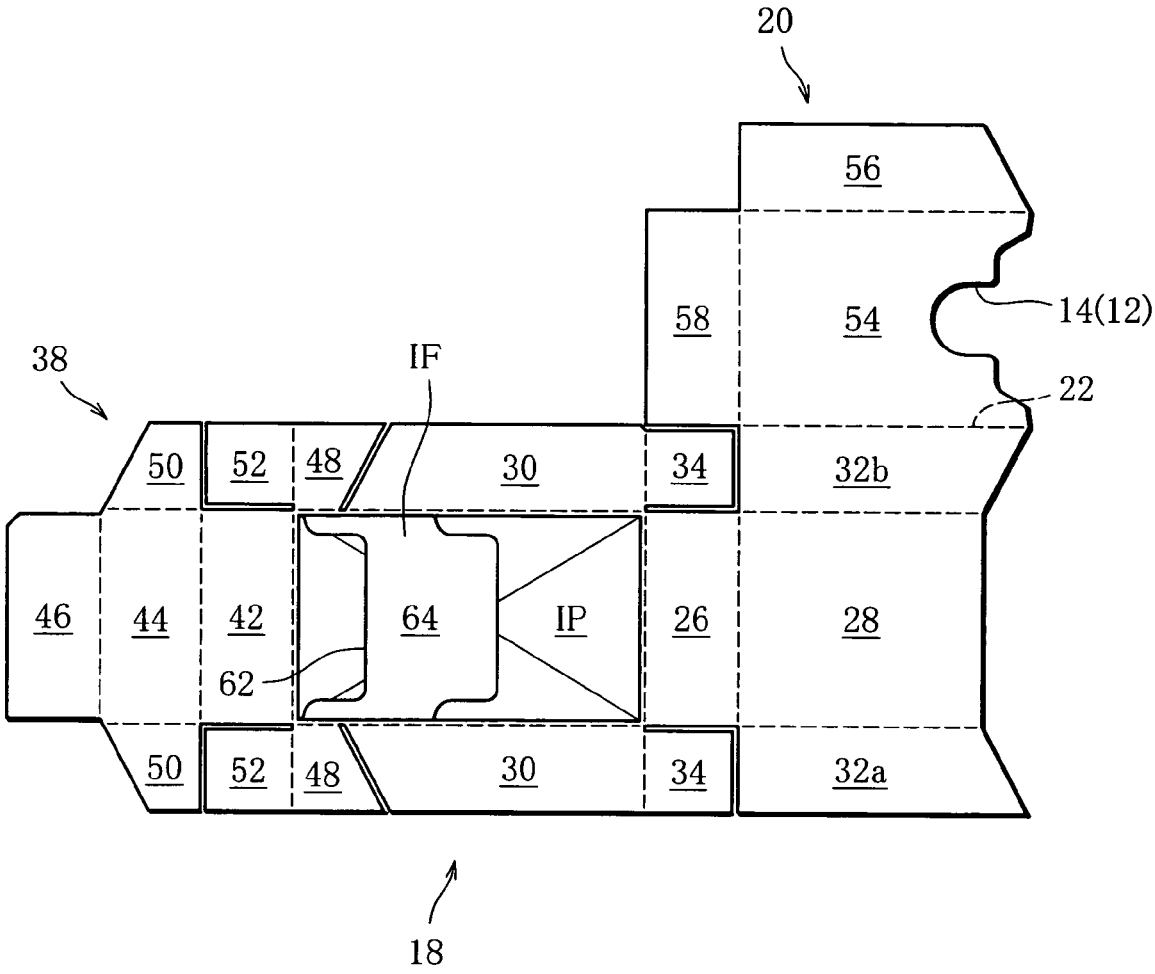
FIG. 7 is a view showing a state in which an inner pack is placed on a back face of the outer blank shown in FIG. 5.

FIG. 7 shows a state in which an inner pack IP with an inner frame IF is placed on a back face of the outer blank. The inner frame IF is formed of the inner blank 60, and is attached to the inner pack IP. More specifically, the inner blank 60 is first superposed on a front face of the inner pack IP and bonded to the inner pack IP. At this time, the access cove 62 of the inner blank 60 is placed adjacent to a top face of the inner pack IP. The side flaps 66 of the inner blank 60 are substantially folded along fold lines toward respective side faces of the inner pack IP, and are superposed on and bonded to the side faces.

The back face of the outer blank is already applied with glue, not shown, at a plurality of required locations, and a back face of the inner pack IP is bonded to the outer blank. In concrete terms, as is evident from FIG. 7, the inner pack IP is placed on the rear panel 40 and the rear panel 24. The top face of the inner pack IP is located along a fold line between the back panel 40 and the top panel 42, and a bottom face of the inner pack IP between the rear panel 24 and the bottom panel 26.

From the state shown in FIG. 7, the panels and flaps of the main section 18 of the outer blank are folded in a well-known manner. As a result, the main section 18 is brought into a state shown in FIG. 8.

Figure 8:
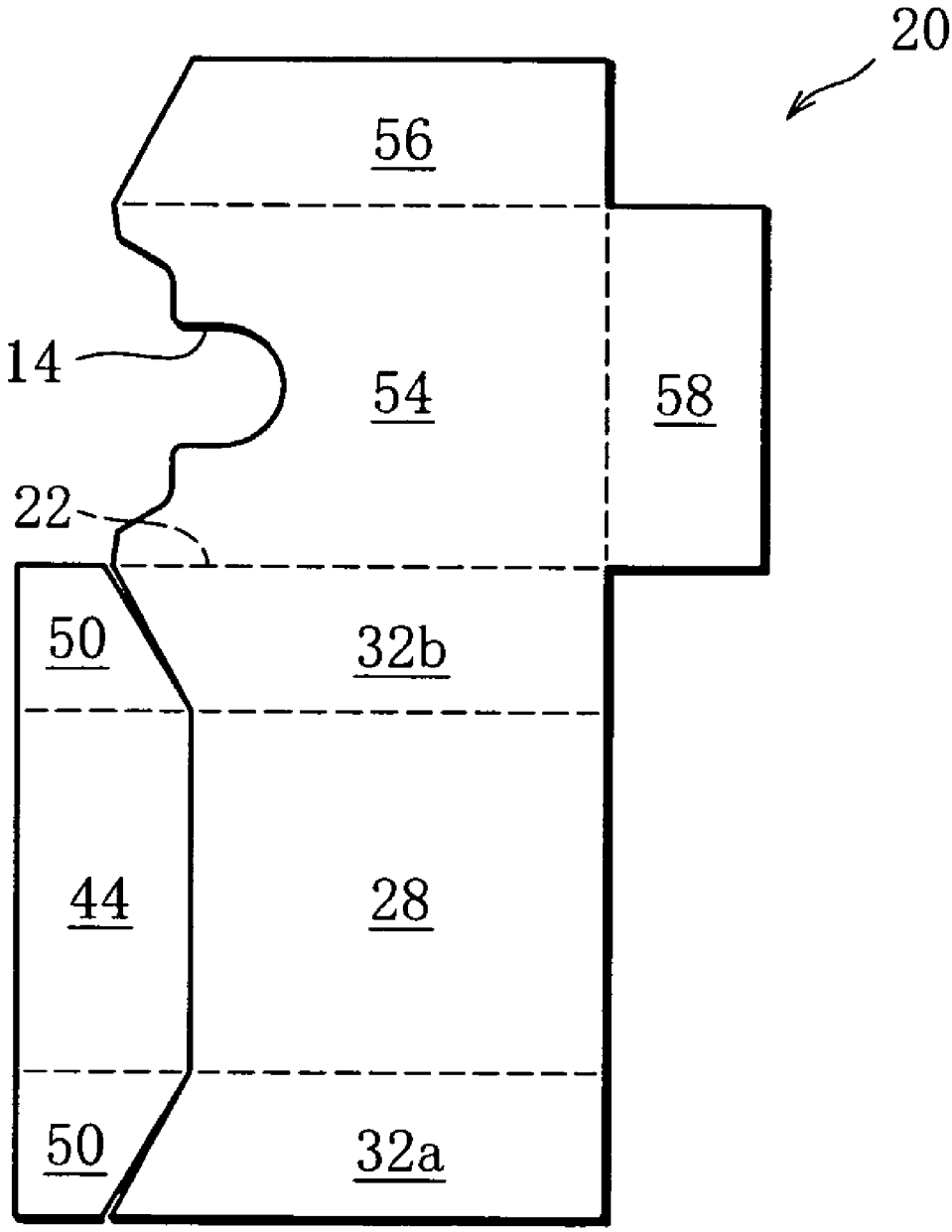
FIG. 8 is a view showing a state in which the outer blank is folded around the inner pack from the state shown in FIG. 7.

In the state shown in FIG. 8, the front panels 28 and 44 are superposed on the front face of the inner pack IP with the inner frame IF interposed therebetween. The front panel 28 is bonded to the inner frame IF. The middle side flap 32*a* and the outer side flaps 32*b* are protruding from both sides of the front panel 28. The outer side flaps 50 are protruding from both sides of the front panel 44. At this time, the subsection 20 is in plane with the panels 28 and 44 and the flaps 32*a*, 32*b* and 50.

The outer side flap 50 adjacent to the middle side flap 32*a* is folded along a fold line toward a first side face of the inner pack IP. At this time, the inner side flaps 30 and 48 of the main section 18 have already been folded and superposed on and bonded to the first side face of the inner pack IP. Accordingly, the folding of the middle side flap 32*a* and the outer side flap 50 makes the flaps 32*a* and 50 superposed on and bonded to the inner side flaps 30 and 48, respectively.

At the same time as the folding of the flaps 32*a* and 50, the outer side flap 32*b* and the outer side flap 50 adjacent to the side flap 32*b* are also folded along fold lines toward a second side wall of the inner pack IP. Therefore, the side flaps 32*b* and 50 are superposed on and bonded to the inner side flaps 30 and 48 that have already been folded on the side of the second side wall. The state of the outer blank at this time is shown in FIG. 9.

Figure 9:
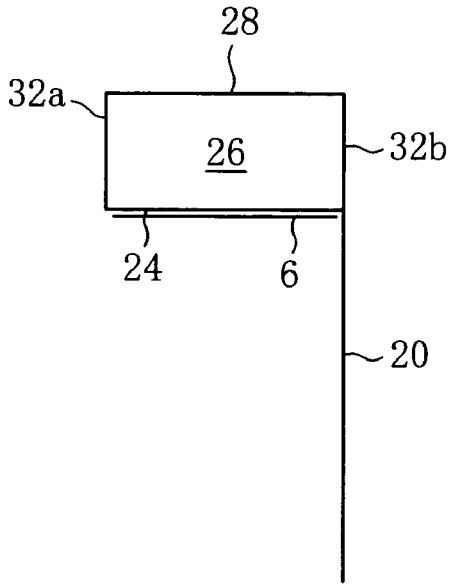
FIG. 9 is a view showing a state in which the outer blank is further folded from the state shown in FIG. 8.

Subsequently, as illustrated in FIG. 9, at least one pouch 6 is placed in the concave 16 that has already been formed in an outer surface of the rear panel 24 and of the rear panel 40. The outer rear panel 54 of the subsection 20 is folded along the fold line 22 toward the rear panel 24, namely the pouch 6, and is superposed on the pouch 6. Therefore, the pouch 6 is sandwiched between the outer rear panel 54 and the rear panel 24.

Figure 10:
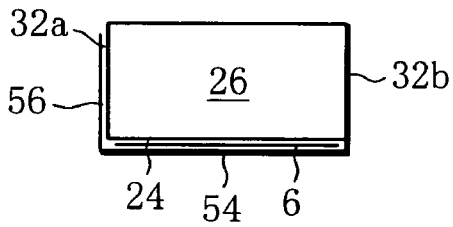
FIG. 10 is a view showing a state in which an outer rear panel and outer side flaps of a subsection are folded in order from the state shown in FIG. 9.
Figure 11:
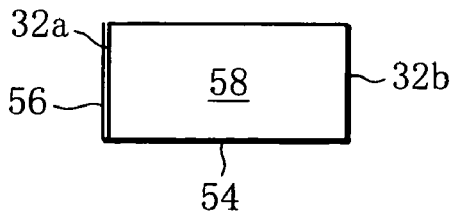
FIG. 11 is a view showing a state in which an outer bottom flap of the subsection is folded from the state shown in FIG. 10.

The outer side flap 56 of the subsection 20 is folded along the fold line toward the middle side flap 32*a*. Accordingly, the outer side flap 56 is superposed on and bonded to the middle side flap 32*a*. This state is shown in FIG. 10.

Simultaneously with or after the folding of the outer side flap 56, the outer bottom panel 58 of the subsection 20 is folded along a fold line toward the inner bottom panel 26. As a result, the outer bottom panel 58 is superposed on and bonded to the inner bottom panel 26 (see FIG. 11). At this time, the cigarette box CB shown in FIGS. 1 to 3 is finished. The finished cigarette box CB is wrapped in a film.

Figure 12:
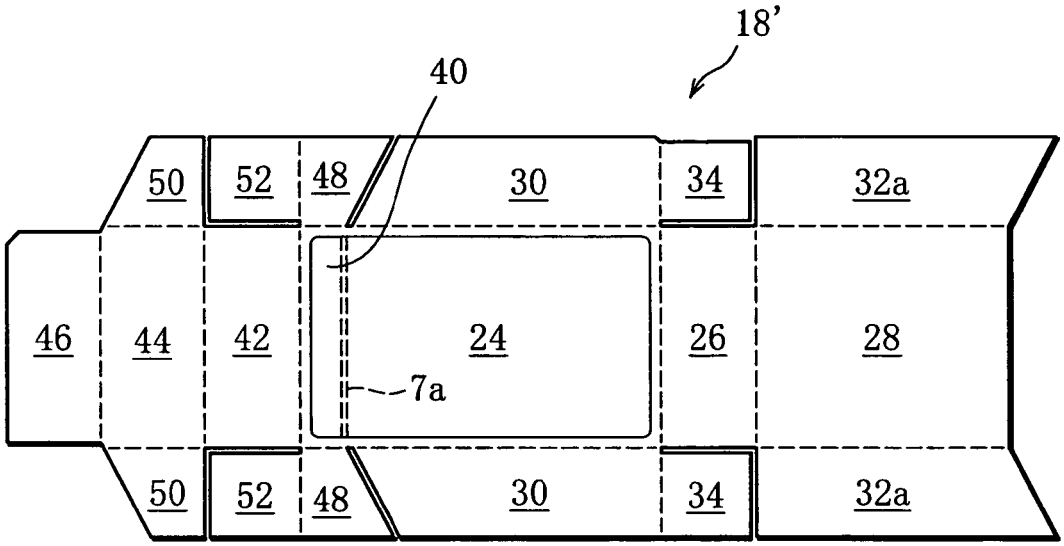
FIG. 12 is a view showing a main part of an outer blank according to a second embodiment.
Figure 13:
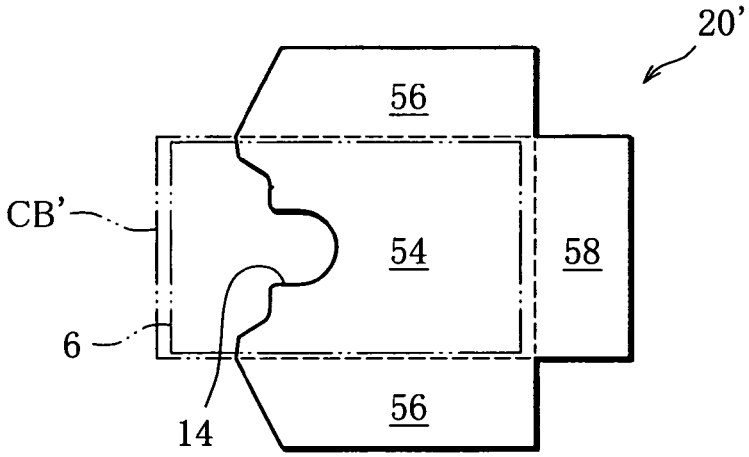
FIG. 13 is a view showing a sub-part of the outer blank according to the second embodiment.

FIGS. 12 and 13 show an outer blank according to a second embodiment.

The outer blank of the second embodiment includes a main part 18' shown in FIG. 12 and a sub-part 20' in FIG. 13. The main part 18' has panels and flaps similar to those of the main section 18, except middle side flaps 32*a* are located on both sides of a front panel 28. This means that the main part 18' corresponds to a blank for fabricating a conventional hinged-lid package. The sub-part 20' simply includes outer side flaps 56 in both sides of an outer rear panel 54, and differs from the subsection 20.

In FIGS. 12 and 13, the panels and flaps corresponding to those in FIG. 7 are provided with the same respective reference numerals.

The main part 18' of FIG. 12 is folded around an inner pack IP having an inner frame IF in a well-known manner, thereby forming a cigarette box CB'. Thereafter, as illustrated in FIG. 13, at least one pouch 6 is placed in a concave 16 formed in a rear face of the cigarette box CB'. The sub-part 20' is then disposed on the pouch 6. The pouch 6 is sandwiched between the rear face of the cigarette CB' and the outer rear panel 54 of the sub-part 20'.

Figure 14:
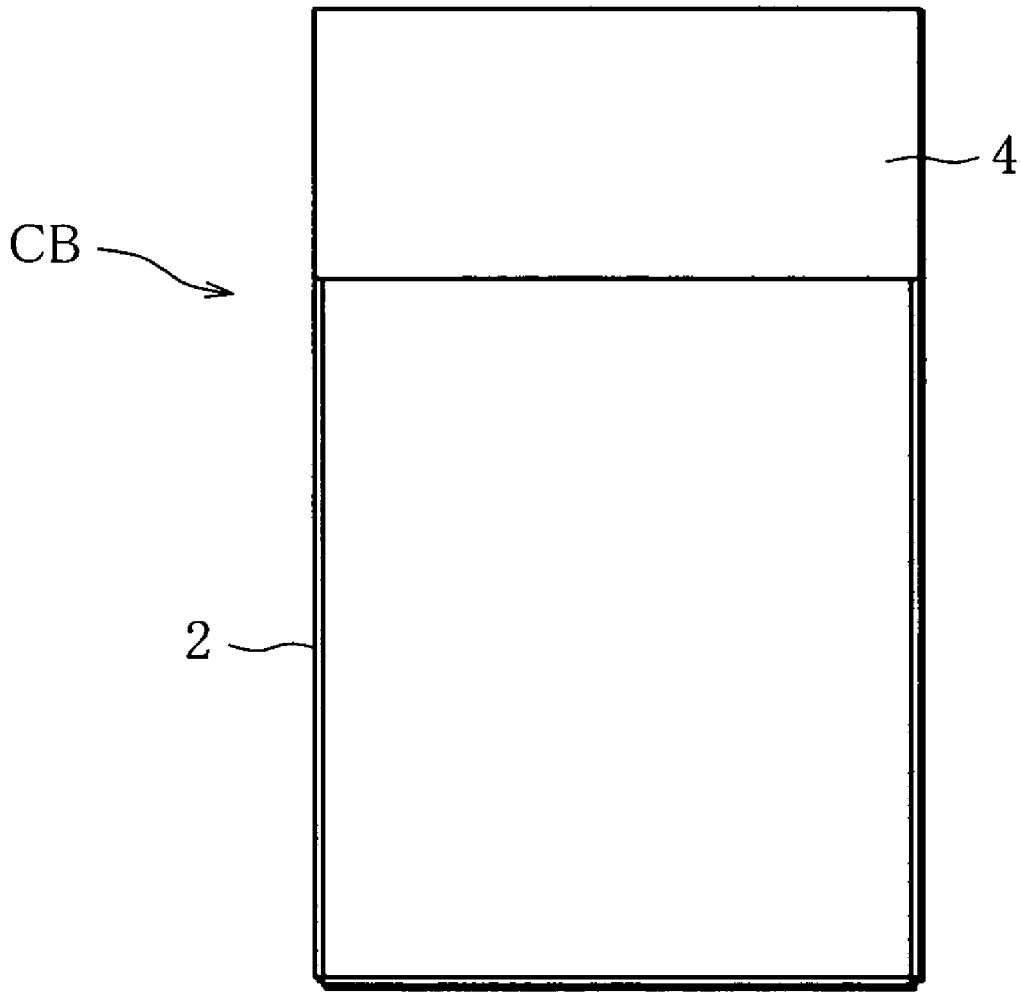
FIG. 14 is a front view of a cigarette box fabricated using the main part and the sub-part shown in FIGS. 12 and 13.

In the next place, both the outer side flaps 56 and an outer bottom panel 58 of the sub-part 20' are folded, thereby finishing the cigarette box CB of the second embodiment. This cigarette box CB is illustrated in FIG. 14. As is apparent from FIG. 14, the cigarette box CB of the second embodiment has a double-structure side walls.

The pocket P of the invention is applicable not only to the hinged-lid type but to a tongue-lid cigarette box. In the case of a tongue-lid box, the inner frame is not necessary.

In the embodiments, a portable ash container, or the pouch 6, serving as the sheet-like article is contained in the pocket P. Instead of the pouch, however, a sheet-like article in another form, such as a coupon and an advertisement, may be contained in the pocket P.

The invention claimed is:

1. An outer blank for fabricating a hinged-lid cigarette box comprising:

a main section with a longitudinal axis and a subsection for providing a pocket to the box, wherein:

said main section includes:

a first rear panel, a first bottom panel, and a first front panel for forming a rear wall, a bottom, and a front wall of the box, the first rear panel, the first bottom panel, and the first front panel being aligned along the longitudinal axis in the order named and demarcated by fold lines between adjacent panels;

first inner side flaps connected to both side edges of the first rear panel across fold lines;

first outer side flaps connected to both side edges of the first front panel across fold lines, for forming both side walls of the box in cooperation with the first inner side flaps; and a lid part connected to an edge of the first rear panel located opposite to the first bottom panel across a hinge line serving as the hinge of the box, for forming a lid of the box, the lid part extending along the longitudinal axis, wherein:

the lid part includes:

a back panel, a top panel, and a second front panel for forming a rear wall, a top wall, and a front wall of the lid, the back panel, the top panel, and the second front panel being aligned along the longitudinal axis in the order named and demarcated by fold lines between adjacent panels;

second inner side flaps connected to both sides of the first rear panel across fold lines; and second outer side flaps connected to both sides of the second front panel across fold lines, for forming both side walls of the lid in cooperation with the second inner side flaps, an inner top flap connected to the top side of each second inner side flap across fold lines, wherein:

said subsection includes:

a second rear panel connected to a side edge of one of the first outer side flaps across a fold line, for being superposed on the rear wall of the box to define said pocket having a mouth positioned on the hinge, toward the bottom of the box;

a second outer flap connected across a fold line to a side edge of the second rear panel located opposite to the one of the first outer side flaps, for being superposed upon a corresponding side wall of the box; and a second bottom panel connected across a fold line to an end edge of the second rear panel located on the first bottom panel side, for being superposed upon a bottom of the box.

2. The outer blank according to claim 1, wherein:

the second rear panel has such a size that when the second rear panel is superposed upon the rear wall of the box, the end edge of the second rear panel located on the hinge side is positioned on the hinge or off the hinge toward the bottom of the box.

3. The outer blank for fabricating a hinged-lid cigarette box of claim 1, wherein the main section and the subsection are formed of separate blanks.

4. An outer blank for fabricating a hinged-lid cigarette box comprising: a main section with a longitudinal axis and a subsection for providing a pocket to the box, wherein: said main section includes: a first rear panel, a first bottom panel, and a first front panel for forming a rear wall, a bottom, and a front wall of the box, the first rear panel, the first bottom panel, and the first front panel being aligned along the longitudinal axis in the order named and demarcated by fold lines between adjacent panels; first inner side flaps connected to both side edges of the first rear panel across fold lines; first outer side flaps connected to both side edges of the first front panel across fold lines, for forming both side walls of the box in cooperation with the first inner side flaps; and a lid part connected to an edge of the first rear panel located opposite to the first bottom panel across a hinge line serving as the hinge of the box, for forming a lid of the box, the lid part extending along the longitudinal axis, wherein: the lid part includes: a back panel, a top panel, and a second front panel for forming a rear wall, a top wall, and a front wall of the lid, the back panel, the top panel, and the second front panel being aligned along the longitudinal axis in the order named and demarcated by fold lines between adjacent panels; second inner side flaps connected to both sides of the first rear panel across fold lines; and second outer side flaps connected to both sides of the second front panel across fold lines, for forming both side walls of the lid in cooperation with the second inner side flaps, an inner top flap connected to the top side of each second inner side flap across fold lines, wherein: said subsection includes: a second rear panel connected to a side edge of one of the first outer side flaps across a fold line, for being superposed on the rear wall of the box to define said pocket having a mouth positioned off the hinge, toward the bottom of the box; a second outer flap connected across a fold line to a side edge of the second rear panel located opposite to the one of the first outer side flaps, for being superposed upon a corresponding side wall of the box; and a second bottom panel connected across a fold line to an end edge of the second rear panel located on the first bottom panel side, for being superposed upon a bottom of the box.

* * * * *